US011619889B2

(12) United States Patent
Nagaoka et al.

(10) Patent No.: US 11,619,889 B2
(45) Date of Patent: Apr. 4, 2023

(54) TWO-COMPONENT DEVELOPER, DEVELOPING DEVICE, AND IMAGE FORMING DEVICE

(71) Applicant: SHARP KABUSHIKI KAISHA, Sakai (JP)

(72) Inventors: Maiko Nagaoka, Sakai (JP); Yoritaka Tsubaki, Sakai (JP); Takeshi Katoh, Sakai (JP); Keiichi Kikawa, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/403,002

(22) Filed: Aug. 16, 2021

(65) Prior Publication Data

US 2022/0066338 A1 Mar. 3, 2022

(30) Foreign Application Priority Data

Aug. 26, 2020 (JP) ..... JP2020-142413

(51) Int. Cl.

| | |
|---|---|
| ***G03G 9/08*** | (2006.01) |
| ***G03G 15/08*** | (2006.01) |
| ***G03G 9/097*** | (2006.01) |
| ***G03G 9/107*** | (2006.01) |
| ***G03G 9/10*** | (2006.01) |
| ***G03G 9/113*** | (2006.01) |

(52) U.S. Cl.

CPC ..... *G03G 9/0819* (2013.01); *G03G 9/0823* (2013.01); *G03G 9/09725* (2013.01); *G03G 9/10* (2013.01); *G03G 9/108* (2020.08); *G03G 9/113* (2013.01); *G03G 9/1136* (2013.01); *G03G 15/0808* (2013.01)

(58) Field of Classification Search

CPC ..... G03G 9/0819; G03G 9/0823; G03G 9/09725; G03G 9/10; G03G 9/108; G03G 9/113; G03G 9/1136; G03G 15/0808

See application file for complete search history.

(56) References Cited

U.S. PATENT DOCUMENTS

| | | | | |
|---|---|---|---|---|
| 8,741,525 | B2 * | 6/2014 | Wada | G03G 9/09716 430/111.3 |
| 2003/0129515 | A1 | 7/2003 | Yamazaki et al. | |
| 2010/0183340 | A1 * | 7/2010 | Wada | G03G 9/107 399/252 |
| 2011/0129772 | A1 * | 6/2011 | Iwata | G03G 9/1075 430/108.6 |

(Continued)

FOREIGN PATENT DOCUMENTS

| | | | |
|---|---|---|---|
| JP | 2003-107805 A | | 4/2003 |
| JP | 2004219935 A | * | 8/2004 |
| JP | 2005221780 A | * | 8/2005 |

(Continued)

*Primary Examiner* — Ryan D Walsh

(74) *Attorney, Agent, or Firm* — ScienBiziP, P.C.

(57) ABSTRACT

A two-component developer 100 includes a carrier 200 and a toner 300. The carrier 200 satisfies the relationships $100 \leq \alpha \leq 220$ and $300 \leq \beta \leq 480$ when a voltage is applied in 1 V steps by a bridge resistance measurement method, where $\alpha$ (V) is a carrier voltage value obtained when a current value flowing through the carrier 200 reaches $1.0^{-7}$ (A), and $\beta$ (V) is a carrier voltage value obtained when the current value reaches $1.0^{-5}$ (A).

15 Claims, 3 Drawing Sheets

(56) References Cited

U.S. PATENT DOCUMENTS

2017/0115589 A1* 4/2017 Nakai ..... G03G 9/0819

FOREIGN PATENT DOCUMENTS

| | | | | | |
|---|---|---|---|---|---|
| JP | 2006227178 | A | * | 8/2006 | |
| JP | 2006301569 | A | * | 11/2006 | |
| JP | 2009020211 | A | * | 1/2009 | ..... G03G 15/09 |
| JP | 4244641 | B2 | * | 3/2009 | |
| JP | 2009258384 | A | * | 11/2009 | |
| JP | 2010276730 | A | * | 12/2010 | ..... G03G 9/1075 |
| JP | 2012083389 | A | * | 4/2012 | |
| JP | 2013120281 | A | * | 6/2013 | |
| JP | 6511320 | B2 | * | 5/2019 | |

* cited by examiner

TWO-COMPONENT DEVELOPER, DEVELOPING DEVICE, AND IMAGE FORMING DEVICE

BACKGROUND OF THE INVENTION

Field of the Invention

The present invention relates to a two-component developer containing a carrier and a toner, a developing device using the two-component developer, and an image forming device provided with the developing device.

Description of the Background Art

In image formation by the electrophotographic method, an electrostatic latent image formed on an image carrier such as a photoreceptor is developed and visualized by a toner. Two types of such a development method are conventionally known, namely a with-rotation development method and a counter-rotation development method according to the rotation directions of a photoreceptor and a developing sleeve, which rotates while holding a developer. Among these, the counter-rotation development method is a development method in which the rotation direction of the photoreceptor and the rotation direction of the developing sleeve are the same direction. In the developing region, development occurs due to the surface of the photoreceptor and the developer on the surface of the developing sleeve making contact from opposite directions. Consequently, it is possible to widen the development nip width and to ensure adequate development properties even with a small amount of developer. An advantage is also that the size of the developer tank can be reduced. On the other hand, there is a problem that the contact time with the developer is short, and image defects such as a fogging phenomenon are likely to occur.

A charging method such as a contact charging roller method or a non-charging roller method is used, where a charging roller is provided in the periphery of the photoreceptor as a charger. Among these, in the contact charging roller method, a sufficient surface potential can be ensured at low voltages, which has advantages in terms of reducing power consumption and the like. On the other hand, because the charging is performed by contact, scratching of the photoreceptor or filming are likely occur. Therefore, there is a problem that image defects due to uneven charging are likely to occur.

Developers can be divided into one-component developers consisting of only a toner, and two-component developers that contain a toner and a carrier. In particular, two-component developers are widely used due to the stability in the amount of charge held by the toner, which enables high-quality images to be easily obtained. The carrier imparts the function of stably charging the toner to have a desired amount of charge. Therefore, resin-coated carriers in which the surface of a magnetic core particle such as ferrite is coated with a resin are known (for example, see Japanese Unexamined Patent Application Publication No. 2003-107805).

SUMMARY

The conventional two-component developer has a problem that the fogging phenomenon is likely to occur when both the counter-rotation development method and the contact charging roller method are used. In particular, since the risk of the fogging phenomenon increases in a high humidity environment, a two-component developer capable of reducing image defects even in such an environment is being sought.

The present invention has been made in view of the above problems. An object of the present invention is to provide a two-component developer capable of suppressing the occurrence of the fogging phenomenon even when both the counter-rotation development method and the contact charging roller method are used, and which has superior development properties, and to provide a developing device and an image forming device suitable for such a two-component developer.

The solution means of the present invention with respect to the above problems is a two-component developer including: a carrier provided with a carrier core material, and a coating layer covering the carrier core material; and a toner; wherein the carrier satisfies the relationships $100 \leq \alpha \leq 220$ and $300 \leq \beta \leq 480$ when a voltage is applied in 1 V steps by a bridge resistance measurement method, where $\alpha$ (V) is a carrier voltage value obtained when a current value flowing through the carrier reaches $1.0^{-7}$ (A), and $\beta$ (V) is a carrier voltage value obtained when the current value reaches $1.0^{-5}$ (A).

Furthermore, in the two-component developer configured as described above, the carrier core material is preferably a ferrite particle containing at least Mn, Mg, and Sr, and satisfies the relationship $150 \leq \gamma \leq 250$ when a voltage is applied in 1 V steps by the bridge resistance measurement method, where $\gamma$ (V) is a carrier core material voltage value obtained when a current value flowing through the carrier core material reaches $1.0^{-5}$ (A).

In addition, the coating layer is preferably a resin film having a thickness of 0.5 μm or more and 5.0 μm or less.

Moreover, in the toner, a ratio of the number of positively charged toner particles contained among all toner particles is preferably 1% or less.

Also, in the toner, a surface of a toner base particle may be externally provided with associated silica in which two or more primary particles are associated, and the associated silica may have a primary particle diameter of 10 nm or more and 200 nm or less, and be prepared as sol-gel silica with hexamethyldisilazane as a hydrophobizing agent.

A developing device using the two-component developer configured as described above is within the scope of the technical idea of the present invention, wherein the two-component developer is used to develop an electrostatic latent image formed on a photoreceptor and form a visible image.

Furthermore, an image forming device including the developing device according to configured as described above, a photoreceptor on which an electrostatic latent image is formed, and a charging device that charges the photoreceptor is also within the scope of the technical idea of the present invention, wherein the developing device includes a developing sleeve which is provided facing the photoreceptor with a predetermined spacing therebetween, and which supplies the toner by rotating from the opposite direction with respect to the photoreceptor, and making contact with the photoreceptor, the charging device is provided with a charger that makes contact with, and charges, a surface of the photoreceptor, and the spacing is 0.45 mm or more and 0.55 mm or less.

Moreover, in the image forming device having the above configuration, a peripheral speed ratio of the developing sleeve to the photoreceptor is preferably 1.5 or more and 2.3 or less.

Effects of the Invention

According to the present invention, it is possible to suppress the occurrence of the fogging phenomenon caused by toner scattering and the like, and to obtain a developing device and an image forming device capable of stably forming high-quality images with few image defects over a long period of time.

DESCRIPTION OF THE PREFERRED EMBODIMENTS

A two-component developer, a developing device, and an image forming device according to an embodiment of the present invention will be described with reference to the drawings.

The present inventors have thoroughly studied the causes of the fogging phenomenon under various environments, and in the course of conducting diligent research, have focused on the resistance of the developer in the two-component developer. As a result, it has been found that, by using a configuration that controls the resistance value of the carrier within a predetermined range, the occurrence of the fogging phenomenon can be suppressed without a deterioration in the development properties.

In particular, according to the studies by the present inventors, the fogging phenomenon in an image forming device occurs on both the side where the potential difference between the development bias and the surface of the photoreceptor is small, and the side where the potential difference is large. However, it has also been found that the cause in each case is different. Further, in a two-component developer, it has been found that preferable results can be obtained by specifying a configuration for suppressing the fogging phenomenon on the side where the potential difference is small, and specifying a configuration for suppressing the fogging phenomenon on the side where the potential difference is large.

Prior to the description of such a two-component developer, a developing device according to the present invention that develops an electrostatic latent image on a photoreceptor using the two-component developer to form a visible image, and an image forming device including the developing device will be described.

Developing Device and Image Forming Device

Figure 1:
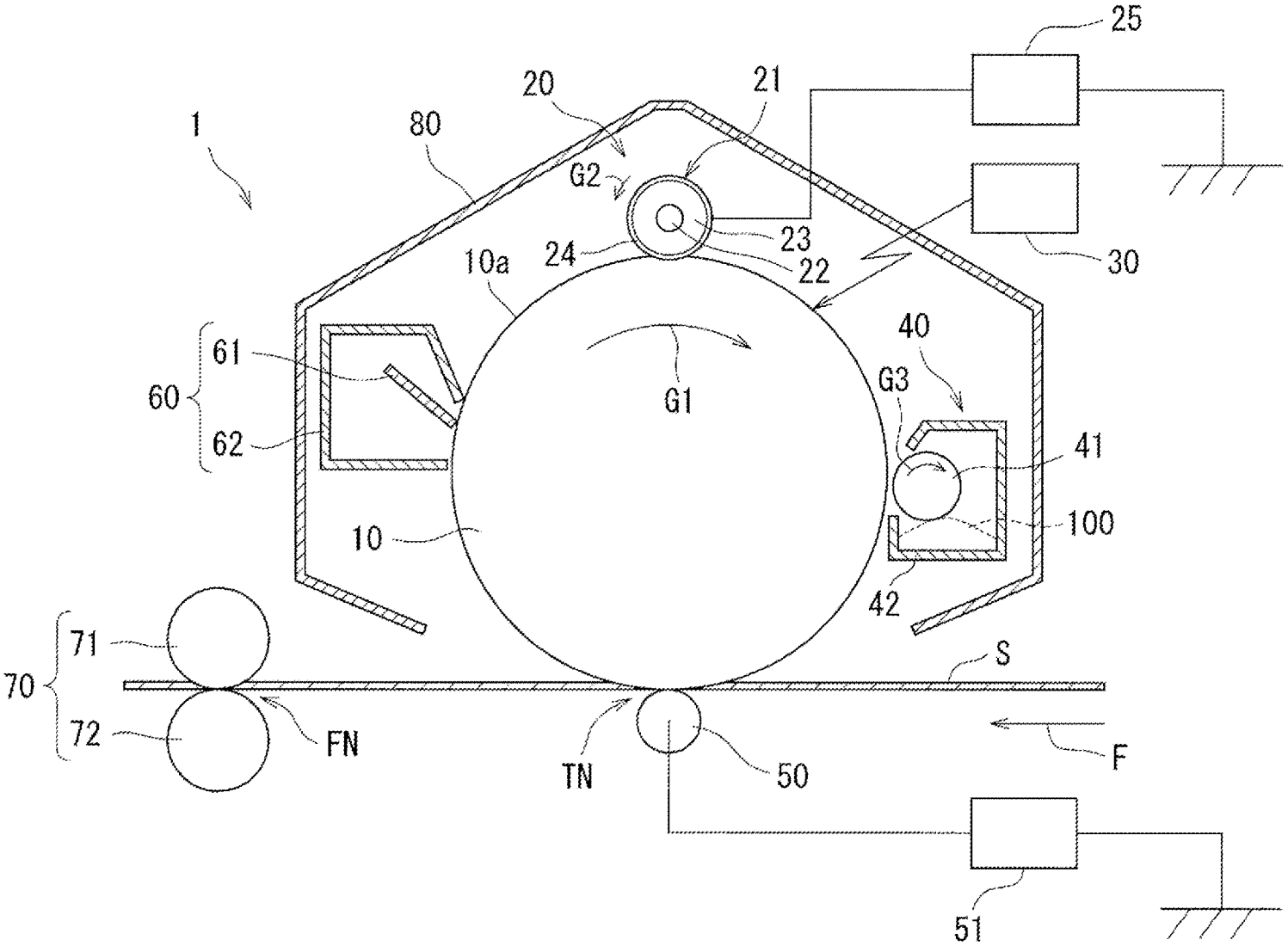
FIG. 1 is a cross-sectional view schematically illustrating an overview configuration of a developing device and an image forming device according to an embodiment of the present invention.

FIG. 1 is a cross-sectional view schematically illustrating an overview configuration of a developing device 40 that develops images using the two-component developer according to an embodiment of the present invention, and an image forming device 1 provided with the developing device 40.

The image forming device 1 includes a photoreceptor 10 that serves as an image carrier, a charging device 20, an exposure device 30, a developing device 40, a transfer device 50, a cleaning device 60, and a fixing device 70. The image forming device 1 further includes a housing 80 that houses each of these components.

The illustrated form of the image forming device 1 is assumed to be a monochrome printer (specifically, a laser printer). However, it may also be, for example, an intermediate transfer method color image forming device that forms color images. In addition, the image forming device 1 is a printer in this example, but may be, for example, a copying machine, a multifunction peripheral, or a facsimile device.

The photoreceptor 10 is rotatably supported by the main body of the image forming device 1 and is rotationally driven in the rotation direction G1 (a clockwise direction in the drawing). The charging device 20 charges the surface 10*a* of the photoreceptor 10. The charging device 20 is provided with a contact charging method charger that charges the surface of the photoreceptor 10 by discharging a conductive member such as a conductive roller, brush, or elastic blade within a narrow gap making contact with the surface 10*a* of the photoreceptor 10.

As such a charger, a charging roller 21 can be exemplified from the viewpoint of charging stability. In this charging method, the conductive charging roller 21 is brought into contact with the photoreceptor 10, and the photoreceptor 10 is uniformly charged by applying a voltage with a high voltage application device 25. The charging roller 21 is rotates with the rotation of the photoreceptor 10, and rotates in the rotation direction G2 (a counterclockwise direction in the drawing) which is the opposite direction to the rotation direction G1.

In the exemplary embodiment, the charging roller 21 includes a rotating shaft 22, a cylindrical elastic member 23 formed on the rotating shaft 22, and a resistance layer 24 formed on the elastic member 23. The elastic member 23 has a conductivity which is appropriate for ensuring a power supply to the photoreceptor 10. The resistance layer 24 is provided so as to adjust the electrical resistance of the entire charging roller 21.

The exposure device 30 exposes the photoreceptor 10 charged by the charging device 20 to form an electrostatic latent image. The exposure device 30 repeatedly scans the surface 10*a* of the rotationally driven photoreceptor 10 with light modulated based on image information in the rotation axis direction of the photoreceptor 10, which represents the main scanning direction.

The developing device 40 includes a developing sleeve 41 and a developer tank 42 that accommodates a two-component developer 100. The developing sleeve 41 is provided so as to face the surface 10*a* of the photoreceptor 10 with a predetermined spacing therebetween, and supplies the photoreceptor 10 with the two-component developer 100. The inside of the developing sleeve 41 is provided with a magnet roller, which is a magnetic field generator. The two-component developer 100 is supplied to the developing sleeve 41, and is supported by the surface of the developing sleeve 41.

The developing device 40 applies a defined development bias to the developing sleeve 41 to form a development electric field in a developing region, which is a region sandwiched between the photoreceptor 10 and the developing sleeve 41. The two-component developer 100 is conveyed to the developing region, and the electrostatic latent image on the photoreceptor 10 is visualized under the development electric field. In the developing device 40 according to the present embodiment, the counter-rotation development method is adopted. The rotation direction G3 of the developing sleeve 41 is the same direction as the rotation direction G1 of the photoreceptor 10. In the developing region, the developing sleeve 41 rotates from the opposite direction to the photoreceptor 10. As a result, the surface 10*a* of the photoreceptor 10 and the two-component developer 100 supported by the surface of the developing sleeve 41 make contact from opposite directions.

The transfer device 50 transfers the toner image formed by the developing device 40 onto a recording medium S such as paper. The transfer device 50 applies a predetermined high voltage to a transfer nip portion TN formed between the photoreceptor 10 and the transfer device 50 by a high voltage applying device 51.

The cleaning device 60 removes and collects the toner remaining on the photoreceptor 10. The cleaning device 60 includes a cleaning blade 61 and a collection casing 62. The cleaning blade 61 removes the toner remaining on the surface 10*a* of the photoreceptor 10. The collection casing 62 houses the toner removed by the cleaning blade 61.

The fixing device 70 fixes the toner image transferred by the transfer device 50 on the recording medium S. The fixing device 70 includes a heating roller 71 and a pressure roller 72. The pressure roller 72 is pressed against the heating roller 71 to form a fixing nip portion FN. In FIG. 1, reference numeral F indicates the transport direction of the recording medium S such as paper.

In the image forming device 1 described above, the spacing between the surfaces of the photoreceptor 10 and the developing sleeve 41 is preferably 0.45 mm or more and 0.55 mm or less. In the present embodiment, because the development method is the counter-rotation development method, at least a certain amount of the two-component developer 100 may be held between the photoreceptor 10 and the developing sleeve 41 at the time of development.

At this time, if the spacing between the surface 10*a* of the photoreceptor 10 and the surface of the developing sleeve 41 is less than 0.45 mm, the two-component developer 100 may overflow and cause a significant deterioration in the development properties. Furthermore, the carrier contained in the two-component developer 100 may also scratch the surface 10*a* of the photoreceptor 10 and cause image defects. On the other hand, if the spacing between the surface 10*a* of the photoreceptor 10 and the surface of the developing sleeve 41 exceeds 0.55 mm, the toner consumption increases and the development properties deteriorate. Therefore, it is preferable that the spacing between the surfaces of the photoreceptor 10 and the developing sleeve 41 is within the above range.

Moreover, the peripheral speed ratio (Vs/Vopc) of the peripheral speed Vs of the developing sleeve 41 to the peripheral speed Vopc of the photoreceptor 10 is preferably 1.5 or more and 2.3 or less. If the peripheral speed ratio is less than 1.5, the opportunity for the magnetic brush to make contact with photoreceptor 10 is excessively reduced. This may cause the toner to be developed to become exhausted and result in a deterioration in the development properties. In addition, if the peripheral speed ratio exceeds 2.3, the load on the two-component developer 100 becomes large, adhesion of the carrier to the photoreceptor 10 becomes more likely. This may cause significant contamination of the toner by the toner or external additive contained in the two-component developer 100. Therefore, if the peripheral speed ratio is less than 1.5, the density becomes low. If the peripheral speed ratio exceeds 2.3, this causes problems such as toner scattering, carrier adhesion, and the durability of the developing sleeve 41. On the other hand, by setting the peripheral speed ratio of the developing sleeve 41 to the photoreceptor 10 within the above range, it is possible to avoid the occurrence of such problems and obtain excellent development properties.

Two-Component Developer

Figure 2:
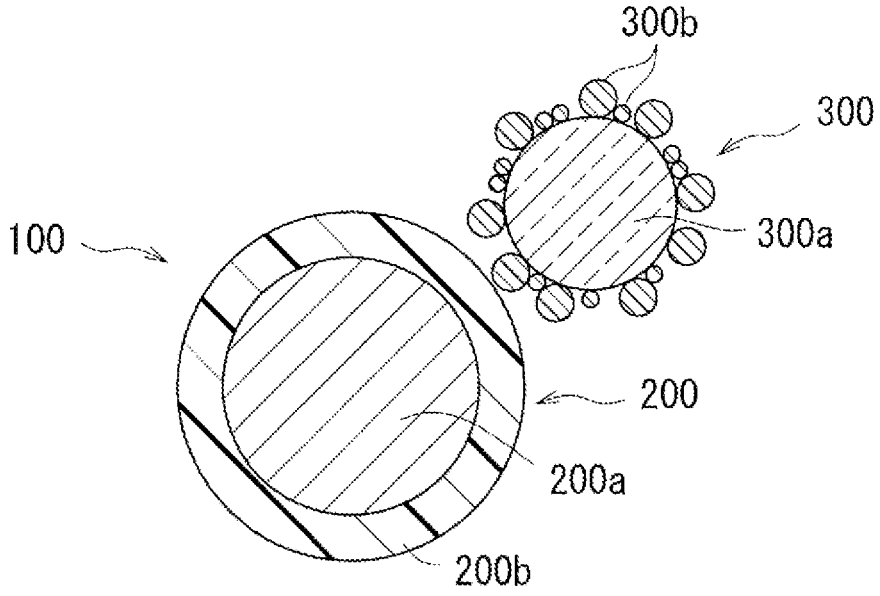
FIG. 2 is a cross-sectional view schematically illustrating a two-component developer according to an embodiment of the present invention.

FIG. 2 is a cross-sectional view schematically illustrating the configuration of the two-component developer 100 according to the present embodiment. As shown in FIG. 2, the two-component developer 100 includes a carrier 200 and a toner 300. The carrier 200 includes a carrier core material 200*a* and a coating layer 200*b* formed on the surface of the carrier core material 200*a*. The toner 300 includes toner base particles 300*a* and a plurality of types of external additives 300*b* having different particle diameters externally attached to the surfaces of the toner base particles 300*a*.

In the image forming device, in the case of a configuration where the photoreceptor is charged by the contact charging roller method as described above, there is a problem that uneven charging originating from the charging roller is likely to occur. Therefore, in the developing region, it is thought that the fogging phenomenon occurs on the side where the potential difference between the development bias and the surface of the photoreceptor is small due to the scattering of toner having a broad distribution in the amount of charge. Consequently, the two-component developer of the present embodiment solves the above problem by controlling the charging properties on the side where the potential difference between the development bias and the surface of the photoreceptor is small. More specifically, the resistance value of the carrier surface (surface resistance value) is controlled.

Furthermore, in the case of a configuration where development is performed by the counter-rotation development method as described above, the contact time with the two-component developer tends to become short. In a negatively charged toner, the carrier is positively charged. However, the negative charge received from the development bias can sometimes flow to the carrier. As a result, the oppositely charged toner (positively charged toner) is attracted to the carrier. Consequently, scattering of the toner is more likely to occur on the side where the potential difference between the development bias and the surface of the photoreceptor is large, and this is thought to cause the fogging phenomenon.

Therefore, the two-component developer of the present embodiment solves the above problem by controlling the carrier resistance value (volume resistance value) in order to suppress the negative charge received from the development bias on the side where the potential difference between the development bias and the surface of the photoreceptor is large. More specifically, the volume resistance value is controlled to be high. However, if it is too high, the development properties may deteriorate due to the potential difference between the apparent development bias and the surface of the photoreceptor being large. Therefore, it is controlled to a volume resistance value that ensures that the development properties can be maintained.

(1) Carrier

In the two-component developer of the present invention, it has been found that the fogging phenomenon can be suppressed by using a configuration that controls the resistance value of the carrier as follows. That is to say, the carrier constituting the two-component developer satisfies the following equations (A) and (B) when a voltage is applied in 1 V steps by a bridge resistance measurement method, where $\alpha$ (V) is a carrier voltage value obtained when a current value flowing through the carrier reaches $1.0^{-7}$ (A), and β (V) is a carrier voltage value obtained when the current value flowing through the carrier reaches $1.0^{-5}$ (A).

$$100 \leq \alpha \leq 220 \quad (A)$$

$$300 \leq \beta \leq 480 \quad (B)$$

The equation (A) obtained by performing a stirring test corresponds to the surface resistance value of the carrier. Furthermore, the equation (B) corresponds to the volume resistance value of the carrier. As a result of the two-component developer containing a carrier that satisfies these conditions, the occurrence of the fogging phenomenon can be suppressed.

Carrier Core Material

Magnetic particles can be used as the carrier core material, and examples include magnetic metals such as iron, copper, nickel and cobalt, and magnetic metal oxides such as ferrite and magnetite. When the carrier core material is a magnetic material, a carrier suitable for a developer used in the magnetic brush development method can be obtained. Among these, magnetic particles (ferrite cores) made of Mn—Mg—Sr-based ferrites, such as iron oxide, manganese oxide, magnesium oxide, and strontium oxide can be preferably used from the viewpoint of having excellent charging performance and durability, and being able to realize a carrier having a suitable saturation magnetization.

Ferrites include soft ferrites exhibiting soft magnetism and hard ferrites exhibiting hard magnetism. However, in the present embodiment, soft ferrites are preferable. Because hard ferrites are magnets, they have a large residual magnetization. Further, carriers may adhere to each other and hinder the fluidity of the two-component developer, or it may be difficult for the carrier to be separated from the magnet roller. On the other hand, by using a soft ferrite, the residual magnetization of the carrier core material can be reduced. In addition, the two-component developer is provided with good fluidity, and the carrier can be easily separated from the magnet roller and the like.

Here, the carrier core material satisfies the following equation (C) when a voltage is applied in 1 V steps by the bridge resistance measurement method, where γ (V) is a carrier core material voltage value obtained when a current value flowing through the carrier core material reaches $1.0^{-5}$ (A).

$$150 \leq \gamma \leq 250 \quad (C)$$

As a result of the voltage value of the carrier core material satisfying equation (C), the effect toward the volume resistance value of the carrier can be suppressed. That is to say, a carrier core material outside the range defined in equation (C) has a tendency to attract negative charge on the side where the potential difference between the development bias and the surface of the photoreceptor is large, and it is difficult to obtain preferable results.

Coating Layer

The coating layer is a resin film, and the resin contained therein (hereinafter referred to as a coating resin) is not particularly limited such that known resins can be used. In the present embodiment, it is preferable to include, for example, a silicone resin or an acrylic-modified silicone resin from the viewpoint of achieving both releasability from the toner and adhesion to the carrier core material. As a result, because the releasability of the toner from the carrier during development can be improved, the development properties can be improved. In addition, the coating layer can be provided with a desired hardness, and the adhesion to the carrier core material can also be improved. Therefore, the effect of stably charging the toner can be prominently exhibited over a long period of time.

Among the coating resins mentioned above, the inclusion of a crosslinked silicone resin leads to even better results. By including a crosslinked silicone resin, because the releasability of the toner from the carrier during development can be further improved, and the development properties can be further improved. In addition, the coating layer can be provided with a desired hardness, and the adhesion to the carrier core material can be further improved. Therefore, the effect of stably charging the toner can be more prominently exhibited over a long period of time. The coating layer may contain a conductive material or a curing accelerator.

The coating layer is preferably a resin film having a thickness of 0.5 μm or more and 5.0 μm or less. More preferably, the thickness of the resin film is 0.5 μm or more and 3.0 μm or less.

If the thickness of the resin film is less than 0.5 μm, the susceptibility to the effect of the resistance of the carrier core material increases, and the surface resistance value and the volume resistance value of the carrier decrease. Furthermore, detachment of the resin film may be promoted over the lifetime, which greatly affects the surface resistance value of the carrier. If the thickness of the resin film exceeds 5.0 μm, the surface resistance value and the volume resistance value of the carrier increase. The fogging phenomenon is likely to occur on the side where the potential difference between the development bias and the surface of the photoreceptor is small, and the development properties also deteriorate. Therefore, it is preferable that the resin film has a coating layer having a thickness in the above range.

Method of Forming Coating Layer

The coating layer is formed by coating the surface of the carrier core material with a resin composition. The resin composition can be produced by mixing a predetermined amount of a crosslinked silicone resin and, if necessary, an appropriate amount of one or more components selected from among conductive particles, an amino group-containing silane coupling agent, a resin other than a silicone resin, and an additive such as a bifunctional silicone oil.

Examples of the form of the resin composition include a solution form, in which the raw material of the resin composition is dissolved or dispersed in an organic solvent. The organic solvent is not particularly limited as long as it is capable of dissolving the silicone resin, and examples include aromatic hydrocarbons such as toluene and xylene, ketones such as acetone and methyl ethyl ketone, ethers such as tetrahydrofuran and dioxane, higher alcohols, and mixed solvents containing two or more of these. The solution-form resin composition is applied as a coating liquid to the surface of the carrier core material to form an application layer. Then, the organic solvent is volatilized and removed from the application layer by heating. Further, a resin film is obtained by heat curing or simply curing the application layer during or after drying, which enables a coating layer to be formed on the surface of the core material of the carrier.

Examples of the application method of the coating liquid to the carrier core material include an immersion method that impregnates the carrier core material with the coating liquid, a spray method that sprays the coating liquid onto the carrier core material, and a fluidized bed method that sprays the coating liquid onto the carrier core material while it is being suspended by a fluidized gas flow.

A drying accelerator may be used to dry the application layer. Known drying accelerators can be used, and examples include naphthenates and octoates of lead, iron, cobalt, and manganese, metal soaps such as zinc salts, and organic amines such as ethanolamine.

Furthermore, a curing accelerator may be used when drying the application layer (coating liquid). In this case, it is preferable to use an organic compound catalyst such as an Sn compound, an Al compound, or a Ti compound, which displays excellent performance as a curing accelerator of the crosslinked silicone resin. These curing catalysts have a function of accelerating the curing of the crosslinked silicone resin. The curing catalyst is preferably contained in an amount of 0.2 to 5 parts by weight with respect to 100 parts by weight of the resin composition of the coating layer.

Conductive Material

The resin composition preferably contains conductive particles as the conductive material. By including conductive particles in the coating layer, it is possible to mitigate the rise in the amount of charge held by the toner immediately after the two-component developer is filled in the image forming device, such as from initialization to the formation of the first 2,000 images. Therefore, it is possible to prevent the amount of charge held by the toner from becoming large immediately after the new two-component developer is set inside the image forming device, and the toner can be more stably charged over a long period of time.

As the conductive particles, for example, oxides such as conductive carbon black, conductive titanium oxide and tin oxide can be used. Carbon black or the like is suitable for exhibiting conductivity with a small addition amount. However, in the case of a color toner, there may be a concern that carbon may detach from the coating layer of the carrier. In that case, conductive titanium oxide or the like doped with antimony may be used.

Measurement of Carrier Resistance Value

Figure 3:
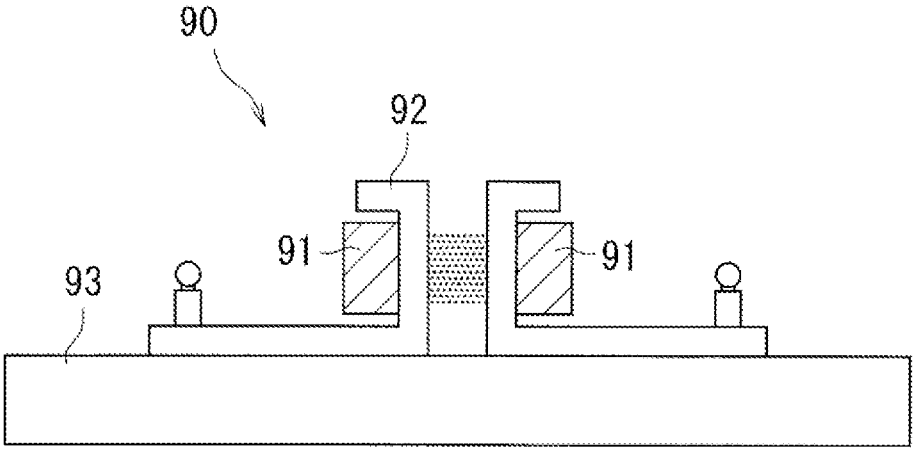
FIG. 3 is a schematic view showing a measurement jig used for measuring the resistance value of magnetic fine particles.

FIG. 3 is a schematic view of a measurement jig 90 used for measuring the resistance value of magnetic fine particles. The resistance value of the carrier can be measured by using the measurement jig 90 shown in the drawing.

The measurement jig 90 includes a magnet 91, aluminum electrodes 92, and an acrylic resin base 93. A spacing between the electrodes 92 is 1 mm, and the electrodes 92 are formed as parallel plate electrodes having a size of 10 mm×40 mm. At the time of measurement, 200 mg of magnetic fine particles are inserted between the electrodes 92. Then, the magnet 91, which has a surface magnetic flux density of 1,500 gauss and opposing sections having a magnet area of 10 mm×30 mm, is arranged such that the north and south poles face each other, and the magnetic fine particles are held between the electrodes 92.

As the magnetic fine particles, the carrier, the carrier core material, or magnetic fine particles similar to the carrier core material can be used. For example, a predetermined amount of the carrier is arranged between the two electrodes 92, and a carrier bridge is formed between the electrodes 92. In that state, a DC voltage is applied between the electrodes 92 in 1 V steps, and the current value flowing through the carrier is measured. The resistance value of the carrier can be obtained from the measured current value, the distance between the electrodes, and the cross-sectional area. The resistance value of the carrier core material can be obtained in the same manner.

Figure 4:
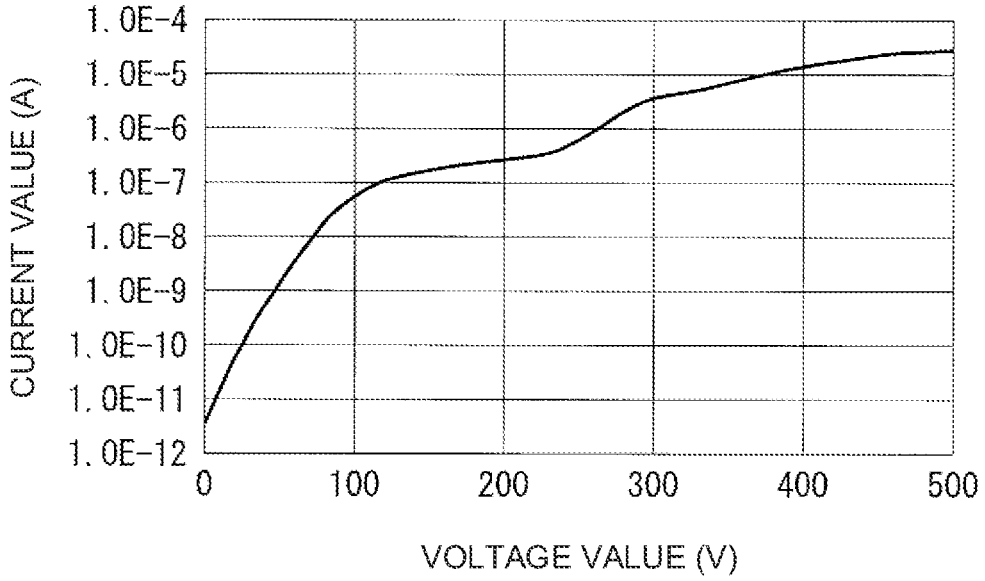
FIG. 4 is a graph showing voltage-current characteristics related to the carrier resistance value of the two-component developer.

FIG. 4 is a graph showing the voltage-current characteristics when the resistance value of the carrier in the two-component developer is measured using the measurement jig 90. When the voltage is applied in 1 V steps, the carrier voltage value when the current value flowing through the carrier reaches $1.0^{-7}$ (A) corresponds to the surface resistance value of the carrier, and it is preferable that this value is controlled so as to satisfy equation (A) above. Furthermore, when the voltage is applied in 1 V steps, the carrier voltage value when the current value flowing through the carrier reaches $1.0^{-5}$ (A) corresponds to the volume resistance value of the carrier, and it is preferable that this value is controlled so as to satisfy equation (B) above. As a result of the carrier in the two-component developer having a controlled resistance value, the occurrence of the fogging phenomenon can be suppressed.

(2) Toner

The toner includes toner base particles and a plurality of types of external additives having different particle diameters externally attached to the surfaces of the toner base particles. The toner base particles contain a binder resin, a colorant, and a release agent as essential components, and also contains a charge control agent and the like.

The binder resin is not particularly limited, and known binder resins for black toner or color toner can be used. Examples include polyester-based resins, styrene-based resins such as polystyrene and styrene-acrylic acid ester copolymer resins, acrylic-based resins such as polymethylmethacrylate, polyolefin-based resins such as polyethylene, polyurethane, and epoxy resins. Furthermore, a resin obtained by mixing a release agent with a raw material monomer mixture and then performing a polymerization reaction may be used. A single type of binder resin may be used alone, or two or more types may be used in combination.

As the colorant, various colorants can be used depending on the desired color, and examples include colorants for yellow toner, colorants for magenta toner, colorants for cyan toner, and colorants for black toner. As the colorant, in addition to these pigments, red pigments, green pigments and the like may also be used. A single type of colorant may be used alone, or two or more types may be used in combination. Furthermore, two or more types of colorants of the same color can be used. It is also possible to use one or more types of colorants of each different color. Release agents commonly used in this field can be used. The charge control agent is added for the purpose of controlling the triboelectricity of the toner.

As the external additive of the toner, those commonly used this field can be used, and examples include silica, silicon oxide, titanium oxide, silicon carbide, aluminum oxide, and barium titanate. The amount of the external additive used is not particularly limited, but is preferably, for example, 0.1 to 3.0 parts by weight with respect to 100 parts by weight of the toner base particles.

Furthermore, in the present embodiment, associated silica, in which two or more primary particles are associated, may be added to the surfaces of the toner base particles as an external additive of the toner. Here, associated silica refers to two or more primary particles of silica that have been associated.

The associated silica is preferably sol-gel silica, in which the primary particle diameter is 10 nm or more and 200 nm or less, with hexamethyldisilazane as a hydrophobizing agent. When the primary particle diameter of the associated silica is in the range of 10 nm or more and 200 nm or less, it is possible to prevent the toner particles from aggregating with each other, and to make the charging of the toner by the carrier uniform. In addition, detachment from the toner becomes less likely. This enables carrier contamination by the external additive to be suppressed, and further, a stable resistance value can be ensured over the entire lifetime.

Furthermore, because the associated silica has been subjected to hydrophobization with hexamethyldisilazane, it is thought that an electrical leak effect can be provided by releasing the moisture inside the silica to the surface in a low-humidity environment, while maintaining the charging obtained under a high-humidity environment. Therefore, it is possible to suppress the adhesion with respect to the photoreceptor.

By including the associated silica described above in the external additive, the charging stability can be further enhanced. Further, the effect of suppressing the fogging phenomenon under various environments can be exhibited while maintaining the resistance value of the carrier at a fixed level. This effect can be most prominently exhibited by externally adding, for example, 0.2 to 2.0 parts by mass of the sol-gel silica described above to 100 parts by mass of the toner base particles.

Moreover, in the toner of the present embodiment, of the total number of toner particles constituting the toner, the ratio of the number of positively charged toner particles (amount of positively charged toner) to the total number of toner particles (total amount of toner) is preferably 1% or less. As described above, on the side where the potential difference between the development bias and the surface of the photoreceptor is large, it is thought that the fogging phenomenon occurs due to the positively charged toner particles being attracted to the carrier. Therefore, by controlling the ratio of the positively charged toner particles to 1% or less with respect to all the toner particles constituting the toner, it is possible to suppress the scattering of the toner and to reduce the fogging phenomenon.

The number of positively charged toner particles can be determined by measuring the particle size and the amount of charge of each particle using a charge distribution measuring device described later, and calculating the number ratio of the number of positively charged toner particles to all the toner particles at each amount of charge.

(3) Production Method of Two-Component Developer

A production method of the two-component developer according to the present embodiment will be described.

The carrier core material contained in the carrier can be produced, for example, by a resin addition method or a silica particle addition method. A method that uses the resin addition method includes a weighing step, a mixing step, a pulverization step, a granulation step, a preliminary calcination step, a calcination step, a crushing step, and a classification step. A method that uses the silica particle addition method includes a weighing step, a mixing step, a pulverization step, a granulation step, a calcination step, a crushing step, and a classification step. Then, the carrier can be produced by performing a coating step for coating the coating liquid on the obtained carrier core material, and forming a coating layer on the surface.

The toner can be produced by a known method such as a kneading pulverization method or an aggregation method. For example, the toner raw materials other than the external additive are premixed by a mixer such as a Henschel mixer, a super mixer, a Mechanomill, or a Q-type mixer, and the obtained raw material mixture is melt-kneaded by a kneader, and then cooled and solidified. The melt-kneaded product of the toner raw material after cooling and solidification is coarsely pulverized by a cutter mill, a feather mill, or the like. The obtained coarsely pulverized product is then finely pulverized. For fine pulverization, a jet mill, a fluidized bed-type jet pulverizer, or the like can be used. A pulverizer pulverizes the toner particles by colliding a gas flow containing the toner particles from a plurality of directions, and causing the toner particles to collide with each other. As a result, non-magnetic toner base particles are produced. Further, an external additive is added to the toner base particles by a known method.

The two-component developer can be produced by mixing the toner and the carrier using a known mixer.

By using the two-component developer according to the present embodiment described above to obtain a developing device and an image forming device having the above configuration, it is possible to form toner images on the photoreceptor in which the fogging phenomenon is suppressed. Further, it is possible to stably form high-quality images with few image defects over a long period of time.

EXAMPLES

Hereinafter, examples of the two-component developer according to the present invention and comparative examples thereof will be described.

Examples 1 to 5

In Examples 1 to 5, the toner contained in the two-component developer was the same, and the resistance value of the carrier was changed. Furthermore, as comparative examples of Examples 1 to 5, in Comparative Examples 1 to 4, the toner contained in the two-component developer was the same as that of Examples 1 to 5, and the resistance value of the carrier was set to different values to Examples 1 to 5.

(1) Preparation of Carrier

Nine types of carriers (carriers 1 to 9) were prepared as follows.

Carrier 1

A coating layer was formed on the surface of the carrier core material, which was a magnetic fine particle made of ferrite (ferrite core). The coating liquid was prepared by dissolving and dispersing in toluene 100 parts by weight of a silicone resin (number average molecular weight: about 15,000), 3 parts by weight of carbon black (primary particle diameter 25 nm, oil absorption 150 mL/100 g) as a conductive material, and 5 parts by mass of octyl acid as a curing agent. The carrier core material was coated with this coating liquid by a spray coating device to prepare the carrier 1. The volume average particle diameter of the carrier 1 was 40 μm, and the thickness of the coating layer (resin film) was 2.0 μm.

Carriers 2 to 9

The carriers 2 to 9 were prepared by adjusting the number of parts of the silicone resin and conductive material. The carrier 3, carrier 4, carrier 6, and carrier 9 had the same composition in terms of the carrier core material and the coating layer, but were prepared with different resistance values. The volume average particle diameter was 40 μm, and the thickness of the coating layer was 2.0 μm or 1.0 μm.

Measurement of Volume Average Particle Diameter

The volume average particle diameter of carriers 1 to 9 was measured using a Microtrac (MT3000, manufactured by Nikkiso Co., Ltd.). Approximately 10 to 15 mg of the measurement sample was added to 10 mL of a 5% aqueous solution of Emulgen 109P (polyoxyethylene lauryl ether HLB 13.6, manufactured by Kao Co., Ltd.) and dispersed with an ultrasonic disperser for 1 minute. Approximately 1 mL of the product was added to a predetermined location of a Microtrac, and the measurement was performed after stirring for 1 minute and confirming that the scattered light intensity was stable.

Measurement of Resistance Value

The resistance value of the carriers 1 to 9 and the resistance value of the carrier core material were measured using the measurement jig 90 (see FIG. 3).

A voltage was applied in 1 V steps, and the carrier voltage value (carrier surface resistance value) $\alpha$ (V) when the current value flowing through the carrier reached $1.0^{-7}$ (A) was set to within the range of $100 \leq \alpha \leq 220$ for the carriers 1 to 5 (equation (A) above). The carrier voltage value (carrier volume resistance value) $\beta$ (V) when the current value flowing through the carrier reached $1.0^{-5}$ (A) was set to within the range of $300 \leq \beta \leq 480$ for the carriers 1 to 5 (equation (B) above).

Furthermore, the carrier voltage value $\gamma$ (V) of the carrier core material when the current value flowing through the carrier core material reached $1.0^{-5}$ (A) was set to within the range of $150 \leq \gamma \leq 250$ for the carriers 1 to 9 (equation (C) above).

Table 1 summarizes the volume average particle diameter, the thickness of the coating layer, the carrier voltage value, and the carrier core material voltage value of the carriers 1 to 9. The carriers 1 to 5 were respectively used in Examples 1 to 5. The carriers 6 to 9 were respectively used in Comparative Examples 1 to 4.

TABLE 1

| | Volume average particle diameter (μm) | Thickness of coating layer (μm) | Voltage at 1.0E−7A (V) | Voltage at 1.0E−5A (V) | Voltage of carrier core material at 1.0E−5A (V) |
|---|---|---|---|---|---|
| Carrier 1 | 40 | 2.0 | 180 | 387 | 173 |
| Carrier 2 | 40 | 2.0 | 130 | 475 | 173 |
| Carrier 3 | 40 | 1.0 | 182 | 332 | 189 |
| Carrier 4 | 40 | 1.0 | 109 | 373 | 189 |
| Carrier 5 | 40 | 2.0 | 124 | 309 | 173 |
| Carrier 6 | 40 | 1.0 | 263 | 378 | 189 |
| Carrier 7 | 40 | 2.0 | 143 | 526 | 173 |
| Carrier 8 | 40 | 2.0 | 261 | 660 | 173 |
| Carrier 9 | 40 | 1.0 | 90 | 223 | 189 |

(2) Preparation of Toner

The toner 1 was prepared as follows, and was used as the toner in each of the two-component developers of Examples 1 to 5 and Comparative Examples 1 to 4.

Toner 1

In terms of the toner base particles, 60 parts by weight of an amorphous polyester resin A, 20 parts by weight of an amorphous polyester resin B, 15 parts by weight of carbon black, 1 part by weight of a boron compound (LR-147, manufactured by Japan Carlit Co., Ltd.), and 3 parts by weight of an ester wax were mixed for 10 minutes in a Henschel mixer serving as the mixer. Then, the mixture was melt-kneaded with a kneading and dispersion treatment device (Kneadex MOS140-800, manufactured by Mitsui Mining Co., Ltd.). After cooling the melt-kneaded product, the kneaded product was coarsely pulverized with a cutting mill, and then finely pulverized using a jet crusher (IDS-2 model, manufactured by Nippon Pneumatic Mfg. Co., Ltd.). After fine pulverization, an air classifier (MP-250 model, manufactured by Nippon Pneumatic Mfg. Co., Ltd.) was used for classification to prepare the toner base particles of the toner 1. In the toner 1, the volume average particle diameter of the toner base particles was 6.8 μm.

As the external additive, conductive silica (RX200, manufactured by Nippon Aerosil Co., Ltd.) having a primary particle diameter of 20 nm to 40 nm was used, and 100 parts by mass of the toner base particles and 1.5 parts by mass of the conductive silica were weighed and placed in a vessel. The toner base particles and the conductive silica were mixed and adhered with a Henschel mixer, and sieved through a 270 mesh sieve to obtain the toner 1.

Ratio of Positively Charged Toner Particles

In the toner 1, the ratio of the number of positively charged toner particles to the total number of toner particles is preferably 1% or less. The number of positively charged toner particles was calculated using a charge distribution measuring device (E-SPART ANALYZER, manufactured by Hosokawa Micron Co., Ltd.). In this case, the two-component developer was attached to a magnetic ring in an environment where the temperature was 25° C. and the humidity was 50%. Then, nitrogen gas was blown to cause toner particles to separate and fall onto a measurement unit. The amount of charge was set to −400 μC/g to 100 μC/g, and the ratio of the number of positively charged toner particles to the total number of toner particles was calculated at each amount of charge. The number ratio of the positively charged toner particles in the toner 1 was 0.2%.

(3) Preparation of Two-Component Developer

The two-component developers according to Examples 1 to 5 were prepared by mixing each of the carriers 1 to 5 with the toner 1. The carrier and toner were mixed by placing 94 parts by weight of the carrier and 6 parts by weight of the toner into a V-shaped mixer (V-5, manufactured by Tokuju Kosakusho Co., Ltd.), and then stirring and mixing for 20 minutes.

As comparative examples with respect to Examples 1 to 5, the two-component developers of Comparative Examples 1 to 4 were prepared by mixing each of the carriers 6 to 9 with the toner 1 in the same manner as in Examples 1 to 5.

The combinations of the carriers 1 to 9 and the toner 1 in each of the examples and comparative examples are summarized in Table 2 described below.

Evaluation of Two-Component Developer

Using the two-component developers of Examples 1 to 5 and Comparative Examples 1 to 4, the presence or absence of the fogging phenomenon and the development properties were evaluated as follows.

Evaluation of Fogging Phenomenon

For the evaluation of the fogging phenomenon, an image forming device (digital monochrome multifunction peripheral, MX-M4070, manufactured by Sharp Corp.) was modified and used as the evaluation machine. The image forming device was filled with the two-component developers of the examples and comparative examples, and after printing 500 images containing image portions and non-image portions, the surface potential of the photoreceptor was regulated to −600 V, and the development bias was adjusted. Then, the potential difference between the development bias and the surface potential of the photoreceptor was set to 200 V on the side where the potential difference is small, and 350 V on the side where the potential difference is large. Then, the whiteness of the non-image portion in the image obtained at each potential difference was measured using a fog measurement device (spectral color difference meter, manufactured by Nippon Denshoku Kogyo Co., Ltd.), and the suppression of the fogging phenomenon (fogging resistance) was evaluated.

The evaluation criteria for the fogging resistance were as follows.

◎: Very good (whiteness of 0.5 or less)

○: Good (whiteness of 0.6 or more and 1.0 or less)

Δ: Fair, within permissible range (whiteness of 1.1 or more and 1.5 or less)

x: Poor (whiteness of 1.6 or more)

Evaluation of Development Properties

For the evaluation of the development properties, an image forming device (digital monochrome multifunction peripheral, MX-M4070, manufactured by Sharp Corp.) was modified and used as the evaluation machine. The image forming device was filled with the two-component developers of the examples and comparative examples, and after printing 500 sheets, the surface potential of the photoreceptor was regulated to −600 V, and the development bias was adjusted. Then, the potential difference between the development bias and the surface potential of the photoreceptor was set to 200 V on the side where the potential difference is small, and 350 V on the side where the potential difference is large. Then, the image density of the image obtained at each potential difference was measured using a spectrophotometric densitometer (X-Rite, manufactured by Videojet X-Rite Co., Ltd.), and the development properties were evaluated.

The evaluation criteria for the development properties were as follows.

◎: Very good (image density of 1.5 or more)

○: Good (image density of 1.4 or more and less than 1.5)

Δ: Fair (image density of 1.3 or more and less than 1.4)

x: Poor (image density of less than 1.3)

Table 2 shows the evaluation results and an overall evaluation result for the two-component developers of Examples 1 to 5 and Comparative Examples 1 to 4.

From the above results, it can be seen that in Examples 1 to 5, the occurrence of the fogging phenomenon could be suppressed, and further, superior development properties were obtained. In particular, examples 1 to 5 respectively use the carriers 1 to 5, in which the carrier voltage values α and β (V) satisfy the equations (A) and (B) above. Consequently, good results were obtained in terms of the fogging resistance and the development properties. On the other hand, in Comparative Examples 1 to 4, the carriers 6 to 9 outside the range of equations (A) and (B) above were used. As a result, the fogging phenomenon occurred, and the image density was poor.

Examples 6 to 9

In Examples 6 to 9, the toner contained in the two-component developer was the same as the toner 1, and in each case the resistance value of the carrier core material was changed.

Carriers 10 to 13

Like the carrier 1, magnetic fine particles made of ferrite (ferrite core) were used as the carrier core material, and a coating layer was formed on the surface. The coating liquid was prepared by dissolving and dispersing in toluene 100 parts by weight of a silicone resin (number average molecular weight: about 15,000), 3 parts by weight of carbon black (primary particle diameter 25 nm, oil absorption 150 mL/100 g) as a conductive material, and 5 parts by mass of octyl acid as a curing agent. The carrier 10 was prepared by coating the carrier core material with this coating liquid using a spray coating device.

The carrier 11 had the same composition as the carrier 10, and was prepared with a different carrier resistance value and carrier core material resistance value. The carriers 12 and 13 were prepared by adjusting the number of parts of the silicone resin and conductive material.

The volume average particle diameter of each of the carriers 10 to 13 was 40 μm, and the thickness of the coating layer (resin film) was 2.0 μm.

Table 3 summarizes the volume average particle diameter, the thickness of the coating layer, the carrier voltage value, and the carrier core material voltage value of the carriers 10 to 13. The carriers 10 to 13 were respectively used in Examples 6 to 9.

TABLE 2

| | Toner | Carrier | Fogging phenomenon at small photential difference | Fogging phenomenon at large photential difference | Development property | Total |
|---|---|---|---|---|---|---|
| Example 1 | Toner 1 | Carrier 1 | ○ | ○ | ○ | ○ |
| Example 2 | Toner 1 | Carrier 2 | ○ | ◎ | Δ | ○ |
| Example 3 | Toner 1 | Carrier 3 | ○ | Δ | ○ | Δ |
| Example 4 | Toner 1 | Carrier 4 | Δ | ○ | ○ | Δ |
| Example 5 | Toner 1 | Carrier 5 | Δ | Δ | ◎ | Δ |
| Comparative Example 1 | Toner 1 | Carrier 6 | X | ○ | ○ | X |
| Comparative Example 2 | Toner 1 | Carrier 7 | ○ | ◎ | X | X |
| Comparative Example 3 | Toner 1 | Carrier 8 | X | ◎ | X | X |
| Comparative Example 4 | Toner 1 | Carrier 9 | X | X | ◎ | X |

TABLE 3

| | Volume average particle diameter (μm) | Thickness of coating layer (μm) | Voltage at 1.0E−7A (V) | Voltage at 1.0E−5A (V) | Voltage of carrier core material at1.0E−5A (V) |
|---|---|---|---|---|---|
| Carrier 1 | 40 | 2.0 | 180 | 387 | 173 |
| Carrier 10 | 40 | 2.0 | 176 | 320 | 153 |
| Carrier 11 | 40 | 2.0 | 178 | 432 | 245 |
| Carrier 12 | 40 | 2.0 | 181 | 312 | 145 |
| Carrier 13 | 40 | 2.0 | 182 | 473 | 270 |

Evaluation of Two-Component Developer

Using the two-component developers of Examples 6 to 9, the presence or absence of the fogging phenomenon and the development properties were evaluated by the same method as in Examples 1 to 5. Table 4 shows the evaluation result and an overall evaluation result for the two-component developers of Examples 6 to 9. Example 1 is also shown in Table 4 as a comparative reference.

TABLE 4

| | Toner | Carrier | Fogging phenomenon at small photential difference | Fogging phenomenon at large photential difference | Development property | Total |
|---|---|---|---|---|---|---|
| Example 1 | Toner 1 | Carrier 1 | ○ | ○ | ○ | ○ |
| Example 6 | Toner 1 | Carrier 10 | ○ | ○ | ○ | ○ |
| Example 7 | Toner 1 | Carrier 11 | ○ | ○ | ○ | ○ |
| Example 8 | Toner 1 | Carrier 12 | ○ | Δ | ○ | Δ |
| Example 9 | Toner 1 | Carrier 13 | ○ | ⊗ | Δ | Δ |

From the above results, it can be seen that Examples 6 to 9 have good fogging resistance and development properties. In particular, in Example 6, Example 7, and Example 1, the carrier 10, the carrier 11, and the carrier 1 were respectively used, which satisfy equation (C) above in terms of the carrier core material voltage value γ (V) when the current value flowing through the carrier is $1.0^{-7}$ (A). Consequently, good results were obtained in terms of the fogging resistance and the development properties.

Examples 10 to 13

In Examples 10 to 13, the toner contained in the two-component developer was the same as the toner 1, and the thickness of the coating layer of the carrier was changed.

Carriers 14 to 17

For each of the carriers 14 to 17, the carrier core material and the coating liquid of the coating layer were the same as that of the carrier 1. However, the two-component developer was configured using a coating layer thickness (resin film thickness) of 0.5 μm or more and 3.0 μm or less for the carriers 14 and 15, and a thickness outside this range for the carriers 16 and 17.

In each of the carriers 14 to 17, the carrier voltage value α (V) when the current value flowing through the carrier is $1.0^{-7}$ (A) was within the range of equation (A) above, and the carrier voltage value β (V) when the current value flowing through the carrier is $1.0^{-5}$ (A) was within the range of equation (B) above. Further, the voltage value γ (V) of the carrier core material when the current value flowing through the carrier core material is $1.0^{-5}$ (A) was 173 V in each case, and was within the range of equation (C) above.

Table 5 summarizes the volume average particle diameter, the thickness of the coating layer, the carrier voltage value, and the carrier core material voltage value of the carriers 10 to 13. The carriers 14 to 17 were respectively used in Examples 10 to 13.

TABLE 5

| | Volume average particle diameter (μm) | Thickness of coating layer (μm) | Voltage at 1.0E−7A (V) | Voltage at 1.0E−5A (V) | Voltage of carrier core material at 1.0E−5A (V) |
|---|---|---|---|---|---|
| Carrier 1 | 40 | 2.0 | 180 | 387 | 173 |
| Carrier 14 | 40 | 0.7 | 149 | 356 | 173 |
| Carrier 15 | 40 | 2.8 | 197 | 411 | 173 |
| Carrier 16 | 40 | 0.3 | 105 | 330 | 173 |
| Carrier 17 | 40 | 4.0 | 207 | 448 | 173 |

Evaluation of Two-Component Developer

Using the two-component developers of Examples 10 to 13, the fogging resistance and development properties were evaluated by the same method as in Examples 1 to 9. Table 6 shows the evaluation results and an overall evaluation result for the two-component developers of Examples 10 to 13. Example 1 is also shown in Table 6 as a comparative reference.

TABLE 6

| | Toner | Carrier | Fogging phenomenon at small photential difference | Fogging phenomenon at large photential difference | Development property | Total |
|---|---|---|---|---|---|---|
| Example 1 | Toner 1 | Carrier 1 | ○ | ○ | ○ | ○ |
| Example 10 | Toner 1 | Carrier 14 | ○ | ○ | ○ | ○ |
| Example 11 | Toner 1 | Carrier 15 | ○ | ○ | ○ | ○ |
| Example 12 | Toner 1 | Carrier 16 | Δ | Δ | ○ | Δ |
| Example 13 | Toner 1 | Carrier 17 | Δ | ○ | Δ | ○ |

From the above results, it can be seen that Examples 10 to 13 have good fogging resistance and development properties. In particular, Example 10, Example 11, and Example 1 respectively used the carrier 14, the carrier 15, and the carrier 1 with a coating layer thickness of 0.5 μm or more and 3.0 μm or less. This resulted in a further enhancement in the fogging resistance and the development properties. In Example 12, because the thickness of the coating layer was less than 0.5 μm, it was thought that the susceptibility to the resistance of the carrier core material would become more likely. However, a good result was obtained in terms of the development properties, and the overall evaluation result was within a permissible range.

Examples 14 and 15

In Examples 14 and 15, the carrier contained in the two-component developer the same as the carrier 1. The toners were configured such that the number ratio of the positively charged toner particles to all the toner particles was different between Example 14 and Example 15.

Toner 2 and Toner 3

The toner 2 and the toner 3 were the same as the toner 1 in terms of the configuration of the toner base particles and the external additives. The ratio of the number of positively charged toner particles to the total number of toner particles was 0.9% in the toner 2, and 1.3% in the toner 3. The configuration of the toner contained in the two-component developer in each example is summarized in Table 8 described later.

Evaluation of Two-Component Developer

Using the two-component developers of Examples 14 and 15, the fogging resistance and development properties were evaluated by the same method as in Examples 1 to 13. Table 7 shows the evaluation results and an overall evaluation result for the two-component developers of Examples 14 and 15. Example 1 is also shown in Table 7 as a comparative reference.

TABLE 7

| | Toner | Carrier | Fogging phenomenon at small photential difference | Fogging phenomenon at large photential difference | Development property | Total |
|---|---|---|---|---|---|---|
| Carrier 1 | Toner 1 | Carrier 1 | ○ | ○ | ○ | ○ |
| Carrier 14 | Toner 2 | Carrier 1 | ○ | ○ | ○ | ○ |
| Carrier 15 | Toner 3 | Carrier 1 | ○ | Δ | ○ | Δ |

From the above results, it can be seen that Examples 14 and Example 15 have good fogging resistance and development properties. In particular, Example 14 and Example 1 respectively used the toner 2 and the toner 1, in which the ratio of the number of positively charged toner particles to the total number of toner particles was 1% or less. This enabled good results to be obtained in terms of the fogging resistance and the development properties.

In Example 15, the toner 3 exceeding 1% was used, in which the ratio of the number of positively charged toner particles to the total number of toner particles was 1.3%. As a result, it is thought that oppositely charged toner (positively charged toner) is attracted to the carrier on the side where the potential difference between the development bias and the surface of the photoreceptor is large, resulting in scattering of the toner becoming more likely, and causing the fogging phenomenon despite being within the permissible range. Therefore, the ratio of the number of positively charged toner particles to the total number of toner particles is preferably 1% or less.

Examples 16 and 17

In Examples 16 and 17, the toner contained in the two-component developer was the same, but the carrier 1 and the carrier 3 were respectively used as the carrier. Therefore, the two-component developer of Example 16 used the carrier 1 and the toner 4. Further, the two-component developer of Example 17 used the carrier 3 and the toner 4.

Toner 4

The toner 4 was prepared by externally adding to the surface of the toner base particles a sol-gel silica in which two or more primary particles having a primary particle diameter of 10 nm or more and 200 nm or less were associated, and which had hexamethyldisilazane as a hydrophobizing agent. The amount of externally added sol-gel silica is preferably 0.2 to 2.0 parts by mass with respect to 100 parts by mass of the toner base particles. The configuration of the toner base particles was the same as that of the toner 1.

Table 8 shows the configurations of the toners 1 to 4 contained in the two-component developers described in the examples above.

TABLE 8

| | Volume average particle diameter (μm) | Existence/ non-existence of sol-gel silica | Ratio of the number of positively charged toner particles (%) |
|---|---|---|---|
| Toner 1 | 6.8 | Non-existence | 0.2 |
| Toner 2 | 6.8 | Non-existence | 0.9 |
| Toner 3 | 6.8 | Non-existence | 1.3 |
| Toner 4 | 6.8 | Existence | 0.2 |

Evaluation of Two-Component Developer

Using the two-component developers of Examples 16 and 17, the fogging resistance and development properties were evaluated by the same method as in Examples 1 to 15. Table 8 shows the evaluation results and an overall evaluation result for the two-component developers of Examples 16 and 17. Example 1 and Example 3 are also shown in Table 9 as comparative references.

TABLE 9

| | Toner | Carrier | Fogging phenomenon at small photential difference | Fogging phenomenon at large photential difference | Development property | Total |
|---|---|---|---|---|---|---|
| Example 1 | Toner 1 | Carrier 1 | ○ | ○ | ○ | ○ |
| Example 3 | Toner 1 | Carrier 3 | ○ | Δ | ○ | Δ |
| Example 16 | Toner 4 | Carrier 1 | ◎ | ○ | ○ | ◎ |
| Example 17 | Toner 4 | Carrier 3 | ◎ | ○ | ○ | ◎ |

From the above results, it can be seen that Examples 16 and Example 17 have good fogging resistance and development properties. In particular, by using the toner 4, in which a sol-gel silica of associated silica was externally added, Example 16 and Example 17 were capable of preventing aggregation of the toner particles when compared with Example 1 and Example 3, which used the toner 1. Further, the charging stability was ensured over the entire lifetime, and the fogging phenomenon could be well-suppressed on the side where the potential difference between the development bias and the surface potential of the photoreceptor was small.

What is claimed is:

1. A two-component developer including:

a carrier provided with a carrier core material, and a coating layer covering the carrier core material; and a toner; wherein the carrier satisfies the relationships $100 \leq \alpha \leq 182$ and $300 \leq \beta \leq 387$ when a voltage is applied in 1 V steps by a bridge resistance measurement method, where α (V) is a carrier voltage value obtained when a current value flowing through the carrier reaches $1.0^{-7}$ (A), and β (V) is a carrier voltage value obtained when the current value reaches $1.0^{-5}$ (A).

2. The two-component developer according to claim 1, wherein the carrier core material is a ferrite particle containing at least Mn, Mg, and Sr, and satisfies the relationship $150 \leq \gamma \leq 250$ when a voltage is applied in 1 V steps by the bridge resistance measurement method, where γ (V) is a carrier core material voltage value obtained when a current value flowing through the carrier core material reaches $1.0^{-5}$ (A).

3. The two-component developer according to claim 1, wherein the coating layer is a resin film having a thickness of 0.5 μm or more and 5.0 μm or less.

4. The two-component developer according to claim 1, wherein in the toner, a ratio of the number of positively charged toner particles contained among all toner particles is 1% or less.

5. The two-component developer according to claim 1, wherein in the toner, a surface of a toner base particle is externally provided with associated silica in which two or more primary particles are associated, and the associated silica has a primary particle diameter of 10 nm or more and 200 nm or less, and is prepared as sol-gel silica with hexamethyldisilazane as a hydrophobizing agent.

6. A developing device that uses the two-component developer according to claim 1 to develop an electrostatic latent image formed on a photoreceptor and form a visible image.

7. An image forming device including:

the developing device according to claim 6;

a photoreceptor on which an electrostatic latent image is formed; and a charging device that charges the photoreceptor; wherein the developing device includes a developing sleeve which is provided facing the photoreceptor with a predetermined spacing therebetween, and which supplies the toner by rotating from an opposite direction with respect to the photoreceptor such that the toner makes contact with the photoreceptor, the charging device uses a contact charging roller method, in which contact is made with a surface of the photoreceptor to charge the surface of the photoreceptor, and the spacing is 0.45 mm or more and 0.55 mm or less.

8. The image forming device according to claim 7, wherein a peripheral speed ratio of the developing sleeve to the photoreceptor is 1.5 or more and 2.3 or less.

9. A two-component developer including:

a carrier provided with a carrier core material, and a coating layer covering the carrier core material; and a toner; wherein the carrier satisfies the relationships $100 \leq \alpha \leq 220$ and $300 \leq \beta \leq 480$ when a voltage is applied in 1 V steps by a bridge resistance measurement method, where α (V) is a carrier voltage value obtained when a current value flowing through the carrier reaches $1.0^{-7}$ (A), and β (V) is a carrier voltage value obtained when the current value reaches $1.0^{-5}$ (A), and the carrier core material is a ferrite particle containing at least Mn, Mg, and Sr, and satisfies the relationship $150 \leq \gamma \leq 250$ when a voltage is applied in 1 V steps by the bridge resistance measurement method, where γ (V) is a carrier core material voltage value obtained when a current value flowing through the carrier core material reaches $1.0^{-5}$ (A).

10. The two-component developer according to claim 9, wherein the coating layer is a resin film having a thickness of 0.5 μm or more and 5.0 μm or less.

11. The two-component developer according to claim 9, wherein in the toner, a ratio of the number of positively charged toner particles contained among all toner particles is 1% or less.

12. The two-component developer according to claim 9, wherein in the toner, a surface of a toner base particle is externally provided with associated silica in which two or more primary particles are associated, and the associated silica has a primary particle diameter of 10 nm or more and 200 nm or less, and is prepared as sol-gel silica with hexamethyldisilazane as a hydrophobizing agent.

13. A developing device that uses the two-component developer according to claim 9 to develop an electrostatic latent image formed on a photoreceptor and form a visible image.

14. An image forming device including:

the developing device according to claim 13;

a photoreceptor on which an electrostatic latent image is formed; and a charging device that charges the photoreceptor; wherein the developing device includes a developing sleeve which is provided facing the photoreceptor with a predetermined spacing therebetween, and which supplies the toner by rotating from an opposite direction with respect to the photoreceptor such that the toner makes contact with the photoreceptor, the charging device uses a contact charging roller method, in which contact is made with a surface of the photoreceptor to charge the surface of the photoreceptor, and the spacing is 0.45 mm or more and 0.55 mm or less.

15. The image forming device according to claim 14, wherein a peripheral speed ratio of the developing sleeve to the photoreceptor is 1.5 or more and 2.3 or less.

* * * * *